United States Patent [19]

Jayaraman et al.

[11] 4,373,702

[45] Feb. 15, 1983

[54] JET IMPINGEMENT/RADIANT HEATING APPARATUS

[75] Inventors: Viswanath Jayaraman, Livonia, Mich.; Carroll Cone, Toledo, Ohio

[73] Assignee: Holcroft & Company, Livonia, Mich.

[21] Appl. No.: 263,630

[22] Filed: May 14, 1981

[51] Int. Cl.[3] ..... C21D 9/56

[52] U.S. Cl. ..... 266/111; 148/153; 148/156; 432/8; 432/31; 432/175; 266/252; 266/103

[58] Field of Search ..... 266/103, 252, 299, 102, 266/111; 432/8, 19, 31, 175; 148/153, 156, 155

[56] References Cited

U.S. PATENT DOCUMENTS

| | | | |
|---|---|---|---|
| 1,948,173 | 2/1934 | Hagan | 266/3 |
| 2,200,732 | 5/1940 | Woodson | 263/3 |
| 2,618,906 | 11/1952 | Hess | 49/55 |
| 2,668,701 | 2/1954 | Dietrich | 263/3 |
| 2,673,728 | 3/1954 | Grosskloss | 263/40 |
| 2,933,425 | 4/1960 | Hess | 148/13 |
| 3,048,383 | 8/1962 | Champlin | 266/5 |
| 3,186,694 | 6/1965 | Beggs | 263/3 |
| 3,208,740 | 9/1965 | Nesbitt et al. | 263/6 |
| 3,262,688 | 7/1966 | Beggs | 266/2 |
| 3,285,240 | 11/1966 | Schmidt | 126/91 A |
| 3,509,867 | 5/1970 | Brosens et al. | 126/116 |
| 4,120,646 | 10/1978 | Groff et al. | 432/121 |
| 4,198,764 | 4/1980 | Ellison et al. | 34/32 |
| 4,202,661 | 5/1980 | Lazaridis et al. | 432/8 |

FOREIGN PATENT DOCUMENTS

| | | | |
|---|---|---|---|
| 1100892 | 5/1965 | United Kingdom | 27/9 |

*Primary Examiner*—L. Dewayne Rutledge
*Assistant Examiner*—Christopher W. Brody
*Attorney, Agent, or Firm*—Herbert E. Messenger; James L. Neal

[57] ABSTRACT

Heat-treating apparatus which includes an insulated furnace compartment through which stock to be heat-treated is passed. Perforated tubes are arranged in the furnace and they are heated to radiance by burners which also generate products of combustion which are ejected through the perforations at high velocity to impinge upon a surface or surfaces of the stock being heat-treated. The combination of radiation and convection enhanced by the impingement of the jets upon a surface of the stock provides highly efficient primary heat transfer. The burners are designed to insure that rapid combustion takes place at a point removed from the perforations to avoid flame issuing from the perforations. The tubes are sized and spaced to enhance secondary heat transfer from gases in the furnace compartment and from the walls of the compartment to the stock.

9 Claims, 5 Drawing Figures

JET IMPINGEMENT/RADIANT HEATING APPARATUS

BACKGROUND OF THE INVENTION

This invention relates in general to the heat-treating of metal and in particular to the heating of metal stock in the form of slabs, sheets, or strips.

A great deal of thought and effort has gone into the development and improvement of efficiency of heat-treating apparatus. The increasing cost of energy has given new impetus to such development, particularly in the field of heat-treatment of metal.

In the case of flat metal stock, for example, continuous treatment of moving lengths of stock is conventional. Generally, the stock to be treated is continuously advanced through a furnace where it is heated radiantly or by convection. In fact, there have been some heat-treating systems where radiation and convection have been used simultaneously to increase the efficiency of heat transfer.

One such system is described in U.S. Pat. No. 4,202,661, entitled "Jet Impingement Radiation Furnace, Method and Apparatus", which issued May 14, 1980 to Thermo Electron Corporation. In this system, strip stock is advanced continuously through a furnace on rollers beneath a perforated refractory plate which is heated to radiance and through which jets of combustion are directed upon the upper surface of the strip stock.

Although the patented system achieved a considerable improvement over systems then in use in efficiency of heating stock by utilizing both radiant and convective heating, the furnace was somewhat cumbersome and involved complex structural elements. For example, the perforated plates and the combustion chambers employed therein presented problems with maintaining acceptable seals and with developing the high pressures and velocities needed for large amounts of convection heat transfer. Moreover, structural complexities limited the system to heating stock only from a single side thereof.

Accordingly, a primary object of the present invention is to improve further the efficiency of combined radiant and convective heating of flat metal stock by simplifying design and reducing the size of the furnace without losing heating productivity.

A further object of the present invention is to heat-treat both sides of flat metal stock continuously with direct convective and direct radiant heating.

Another object of the present invention is to minimize oxidation by rapidly raising the temperature of the material being processed and by utilizing secondary heat transfer to reduce the temperature of flue gases.

Still another object is to reduce the cost of heat-treating materials.

SUMMARY OF THE INVENTION

The system contemplated by the present invention has as its primary application the heat-treatment of metal strip stock such as slabs, sheets, and similar configurations of metal. Although the system in its preferred form is particularly useful and will be described primarily in connection with the preheating of stainless steel strips, its application generally to heat-treating will be readily apparent.

The system includes as a basic component an elongated chamber formed or suitably lined with insulating material which serves as the furnace for receiving the strip stock. Aligned slots are formed in opposite walls of the chamber to permit entry and exit of the strip to be heat-treated. The strip is supported by an entrance roll or rolls as it is introduced through the entry slot. It is then passed between arrays of perforated radiant tubes to an exit slot through which it emerges from the furnace, again deriving support from an exit roll or rolls. Where needed, additional intermediate support rolls made of heat-resisting material may be mounted for rotation within the furnace.

Each radiant tube includes an initial section in which a high efficiency burner is disposed. Combustion takes place rapidly to heat the tube to radiance and simultaneously to eject high velocity jets of the combustion products through the perforations to impinge upon the stock. Both sides of the flat stock are heated not only by direct radiation, but also by convection, the effect of which is enhanced by the impingement of the high velocity jets upon the flat stock surfaces. Secondary heating is derived from radiation from the chamber walls and from the hot gases swirling in the chamber.

For a better understanding of the present invention, together with other objects, features and advantages, reference should be made to the following description of a preferred embodiment to be read in conjunction with the attached drawing in which:

BRIEF DESCRIPTION OF DRAWING

FIG. 3 is a side view of a burner of the type used in the furnace of FIG. 1;

FIG. 4 is an end view of the burner of FIG. 3; and

FIG. 5 is a side view partly broken away to expose structural detail of a radiant tube of the type used in the furnace of FIG. 1.

DESCRIPTION OF PREFERRED EMBODIMENT

Figure 1:
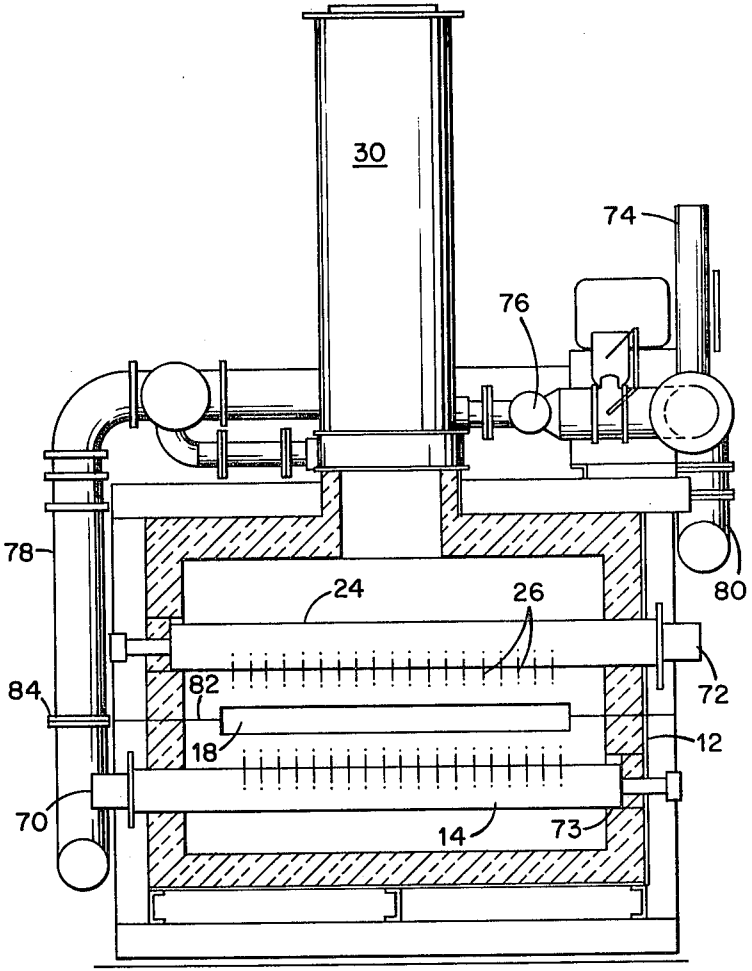
FIG. 1 is an end view partly in section of a strip heating furnace embodying the present invention.
Figure 2:
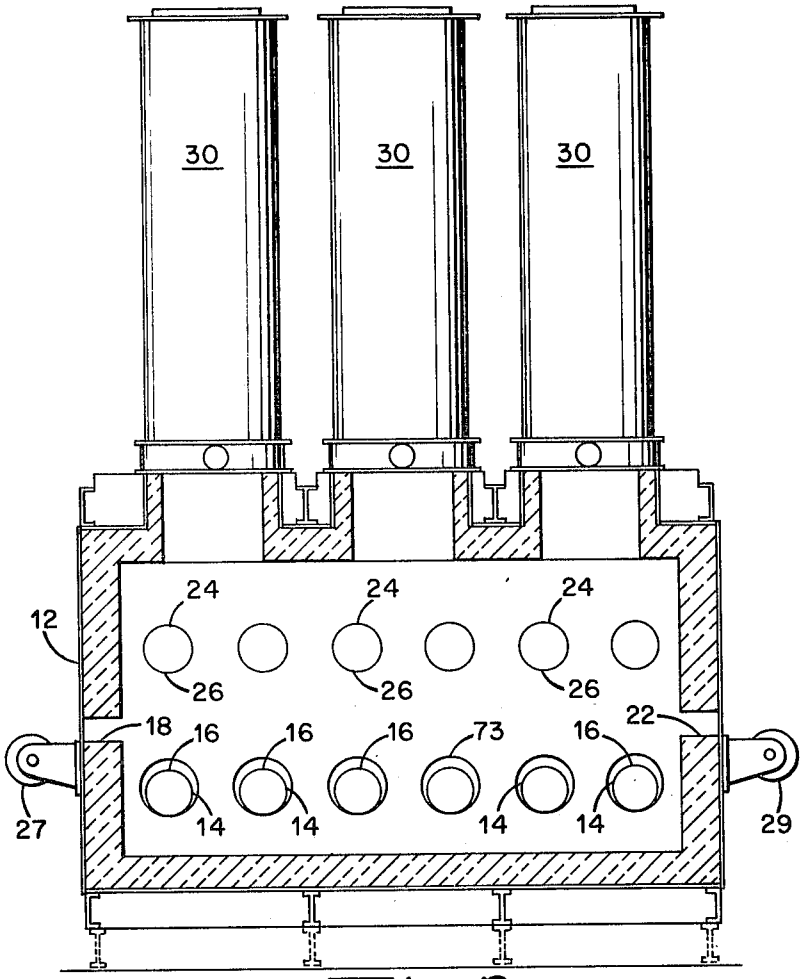
FIG. 2 is a schematic side view also partly in section of the furnace of FIG. 1.

In FIGS. 1 and 2, a heavily insulated enclosure 12 which forms an elongated furnace chamber is shown. The enclosure may be of steel heavily lined with heat-insulating material such as the ceramic fiber material sold under the trademark FIBERFRAX. The enclosure is preferably a two-part structure from which the top half may be removed as a unit for purposes described below. Within the bottom half of the enclosure 12 there is mounted an array of tubes 14 which extend across the interior width of the enclosure, as is more easily seen in FIG. 1. The tubes 14 may be of a heat-resisting metal alloy, or for higher temperature operations, of a ceramic, such as silicon carbide. The tubes are perforated to form a series of spaced openings as at 16 along the central portion of their length. The perforations of each tube 14 are formed in or adjacent the upper surface of the tube. In the case of metallic tubes, ceramic inserts may be provided in each of the perforations to reduce degeneration due to localized overheating and to limit erosion of the walls of the perforation due to the high velocity flow of hot gases.

The structure as shown in FIG. 1 may typically be about 8 ft. in exterior width. The walls of insulating material may be as much as 6 in. in thickness. A length of strip steel to be preheated or otherwise treated may be introduced through the entry slot 18 between the upper and lower halves of the enclosure. The strip entering the slot 18 is supported by an entry roller 27 and passed from left to right as shown in FIG. 2 to emerge at an exit slot 22 where it is supported by an outlet roller 29.

Each of the tubes 14 is heated to radiance and high velocity jets of combustion products emanate from the openings 16 to impinge upon the surface of the metal stock.

In the specific case of preheating steel strip which may run from about 0.07" to 0.375" in thickness, and be of a nominal width of 50", the tubes 14 may run to about 7 ft. in length. The central portion of each tube, which may be about 4½ ft. in length is perforated to form openings of the order of ¾" in diameter spaced about 3" apart. The spacing between the bottom of the strip and the perforated surface of the tubes 14 may be about 8 inches.

The preheating of the strip is usually conducted in preparation for annealing and "pickling" and the strip is advanced through the furnace at a speed of about 24 ft. to 42 ft. per minute. At such speeds and with the apparatus described, the temperature of the strip can easily be raised from ambient to 900° F.

To provide both top and bottom heating of the strip stock, another array of tubes 24 may be disposed in the upper half of the structure which is, roughly, a mirror image of the lower half. The tubes 24 are identical to and disposed in juxtaposition to the tubes 14 in the lower half except for the fact that the perforations 26 are formed in the lower surface of each tube 24 and, as noted below, burners are at opposite tube ends. Also, as shown in both FIGS. 1 and 2, recuperators 30 may be mounted on the upper half of the preheater structure. The combustion products which emerge from the tubes 14 and 24 are exhausted through the recuperators to heat inlet air for the burners which heat the tubes. Greater detail is provided in connection with the figures of the drawings described below.

When a length of strip stock is passed through the preheater, heat is transferred by direct radiation from the tubes 14 or from the combination of tubes 14 and 24 to the stock in a conventional manner. The radiation is directed to both the top and bottom surfaces of the strip. In addition to the radiant heat, however, the perforations in the tubes 14 and 24 cause the products of combustion to be formed into high velocity jets. With such high velocity jets, a highly efficient transfer of heat by convection is effected. The impingement of jets of combustion products upon the surfaces of the strip stock breaks up stagnant boundary layers on the stock surfaces which would otherwise inhibit heat transfer. Secondary heat is also transferred to the stock by radiation from the walls of the enclosure which reach a high temperature from radiation from the radiant tubes, by convection and direct radiation from the hot gases swirling in the chamber, and by reradiation from the walls of heat which they receive by gas radiation, solid radiation from tube surfaces and low velocity convection.

FIGS. 3 and 4 show a burner which is of particular value in the furnace of the present invention. The burner is designed for rapid combustion and high heat release per unit volume of combustion space. In FIG. 3, the burner is shown to include an outer cylindrical body 42 which may conveniently be made of stainless steel. Welded to the exterior of the body 42 is a connecting flange 44 through which bolt holes such as the holes 46 and 48 are formed in a peripheral array. A plate 50 having a central opening to which an inlet air pipe 52 is welded closes off the inlet end of the burner. At the opposite end of the burner body a similar plate 56 is welded to both the burner body and the inlet pipe 52 through which air may flow directly into the radiant tube. The inlet pipe 52 and the plate 56 may conveniently be made of stainless steel. Radial openings to which short nipples are welded are formed in the burner body 42 for the introduction of gas. The nipples 58 and 59 are shown in FIG. 4.

The plate 56 which is shown in greater detail in FIG. 4, includes openings such as the openings 60 and 62 for the outflow of gas from the burner. These openings are drilled at an angle of 60° to the plane of the plate 56, as indicated in FIG. 3, to cause gas flowing from the burner body to be directed inwardly and converge upon the central airstream. As is shown in FIG. 4, the openings such as 60 and 62 may be 36 in number, spaced in a circular array.

It is quite important that flame contact with the stock being treated be avoided so as to prevent local overheating, scaling, decarburization, or other deleterious metallurgical changes in the stock. Thus, it is of considerable value that the burner shown and described herein for use with each of the tubes 14 and 24 achieves rapid and essentially complete combustion in the immediate vicinity of the burner.

During the operation of the burner, the central stream of preheated air emerges from the line 52 where it encounters a converging cone of gas from the openings 60, 62, etc. The momentum of the air stream promotes recirculation and intimate mixing with the gas occurs. A pilot flame which may be fed by a separate line 63 running through the air line 52 ignites the mixture at a point just beyond the plate 56. Substantially complete combustion takes place within a short distance in front of the plate 56 and the products of combustion are carried outwardly from the plate at high velocity.

In FIG. 5, detail on a typical radiant tube is shown. At the right-hand end of the radiant tube as seen in FIG. 5, a flange 66 is welded. The flange 66 is similar to the flange 44 on the burner, and is designed to be bolted to the flange 44 when the burner body 42 is inserted in a radiant tube such as the tube 14. When the tubes are assembled into a furnace, the openings 16 of each tube are staggered with relation to those of adjacent or confronting tubes to provide uniform heating of the strip stock. At the left-hand end of the radiant tube, an end plate 68 is welded, and a monitor tube 69 is welded in an opening in the central portion of the end plate 68.

The monitor tube 69 may be provided with a lens at its end to permit optical inspection of the interior of the radiant tube or a suitable electronic flame sensing device.

Reverting to FIGS. 1 and 2, some exterior detail is shown. It will be noted that the lower radiant tubes 14 are equipped with burners at their left-hand ends, the burner 70 being typical. On the other hand, the upper radiant tubes 24 are provided with burners at their right-hand ends as at 72. The ends of the radiant tubes opposite those in which the burners are disposed are supported in sleeves as at 73, the sleeves being welded to the steel shell of the chamber 12 and surrounded by the insulating materials of the walls of the chamber 12. This method of support permits easy removal and replacement of radiant tubes.

Combustion air for the burners is drawn in by a blower-filter arrangement 74 and driven under pressure into a manifold 76 from which it is fed to the recuperators 30. After preheating which is effected by heat transfer from the exhaust gases passing through the recuperator, the heated air enters the manifolds 78 and 80 which are connected to the inlet burner air lines of the burners as shown at 52 in FIG. 3. The input gas line is connected to the diametrically opposed nipples such as those shown at 58 and 59 on each of the burners.

The furnace compartment is designed for easy service access by removal of the top half of the compartment 12. Midway in the compartment is a parting line which intersects the midpoints at their ends of the slots as at 82. Quick disconnect fittings for air lines, gas and pilot lines and electrical power lines are also employed. The flanges 84 in the manifold 78 are exemplary.

With the apparatus shown, a considerable reduction in volume over known furnaces is achieved for equivalent heating performance. Moreover, the speed at which strip stock is passed through a furnace employing the heating apparatus of the present invention may be substantially increased over that of known systems for heating stock to similar end conditions. Depending upon the temperature range at which heat-treating is done and the emissivity of the material being processed, a significant increase of heat transfer is effected. In the case of stainless steel which is shiny and has low emissivity, radiation alone is a relatively inefficient mode of heat transfer. Utilizing the concepts of the present invention, an increase of 15% to 100% is achieved.

A specific embodiment and application of the present invention has been shown and described, namely, apparatus for heat-treating flat strip stock. However, without departure from the concepts of the present invention, the radiant tubes need not be equally spaced; they need not be equidistant from the stock. Also, the perforations formed in the radiant tubes need not be aligned nor equally sized or spaced; they should simply be so disposed that they cause jets to impinge upon a heat transfer surface at relatively high velocity.

To utilize effectively the direct and reradiated gas radiation from residual products of combustion in the chamber, the volume of the chamber should be sufficient to provide an effective mean path length for gas radiation and the spacing between tubes should be such that radiation from gas and walls can reach the stock. Typically, the tubes in a row have a center-to-center spacing of about two tube diameters, while the distance from the centerlines of a row of tubes to a back-up wall is about 1.5 tube diameters.

The material being treated need have only an impingement surface or surface of reasonable area; various shapes can be accommodated. Also, a considerable degree of waviness is tolerable and does not inhibit enhanced heat transfer by the combined radiation and jet impingement.

The invention should be limited only by the spirit and scope of the appended claims.

What is claimed is:

1. Apparatus for heat-treating flat metal stock comprising an insulated compartment having an entry slot and an exit slot formed in opposite endwalls of said compartment; means for introducing said flat stock into said compartment through said entry slot and for removing said stock through said exit slot such that said stock traverses said compartment along a plane; a first array of tubes of heat-resistant material disposed in spaced relationship to each other equidistant from and beneath said plane, said tubes each extending across at least a portion of the width of said compartment and having a row of perforations formed along the upper surface thereof confronting said plane; a second array of tubes of heat-resistant material disposed in spaced relationship to each other equidistant from, and above said plane, said second array of tubes each extending across at least a portion of the width of said compartment and having a row of perforations formed along the lower surface thereof confronting said plane; each of said tubes of said arrays having a closed end; and a burner positioned adjacent the end of each of said tubes opposite said closed end for generating heated products of combustion within said tubes to heat said tubes to radiance and to eject said heated products of combustion as jets emanating from said perforations, whereby said metal stock is heated by radiation from said tubes and by convection heat transfer by the impingement of said jets upon said stock.

2. Apparatus as defined in claim 1 wherein each said burner includes a central duct for the admission of a stream of air and a chamber surrounding said central duct for the admission of combustible gas, and means for causing said combustible gas to converge upon said stream of air to promote intimate mixing of said combustible air and rapid and essentially complete combustion in the immediate vicinity of said burner.

3. Apparatus as defined in claim 2 wherein said central duct is a cylindrical passage for air, said chamber is a sleeve concentric with said cylindrical passage and said means for causing said combustible gas to converge upon said stream of air comprises a mixing plate forming an end of said burner within said tube, said mixing plate having a central axial opening formed therethrough to permit direct entry of air into said tube and a plurality of openings formed at an angle therethrough to communicate with said sleeve and direct said gas to converge upon said stream of air.

4. Apparatus as defined in claim 1 wherein said perforations of each tube of said first array are in staggered relationship to those of each confronting tube of said second array.

5. Apparatus as defined in claim 1 wherein said perforations of each tube of each array are staggered with respect to the perforations of tubes adjacent thereto whereby impingement of said jets is distributed over said surfaces of said metal member.

6. Apparatus as defined in claim 3 wherein said plurality of openings formed through said mixing plate are at an angle of approximately 60° to the plane of said mixing plate.

7. Apparatus as defined in claim 2 wherein aligned openings are formed in opposite walls of said insulated compartment, each of said array of tubes being end-supported in a pair of said aligned openings.

8. Apparatus as defined in claim 2, including a first flange formed on an end of each of said tubes, a second flange formed on each of said burners, and means for joining each said first flange to a second flange to retain said burners within said tubes.

9. Apparatus as defined in claim 1 wherein said upper half of said compartment and said first array of tubes are separable from said lower half of said compartment and said second array of tubes.

* * * * *